US005375270A

United States Patent [19]

Demers, Jr. et al.

[11] Patent Number: 5,375,270

[45] Date of Patent: Dec. 27, 1994

[54] BEDPAN WASHING GUARD WITH ANTI-SPLASH BACK FEATURE

[76] Inventors: Paul Demers, Jr., 117 Pilgrim Dr., Windsor, Conn. 06095; Robert Barnoski, 80 Granville Rd., North Granby, Conn. 06060

[21] Appl. No.: 236,461

[22] Filed: May 2, 1994

[51] Int. Cl.[5] ..... A61G 9/00

[52] U.S. Cl. ..... 4/457; 4/300.3; 4/658

[58] Field of Search ..... 4/300.2, 300.3, 457, 4/658, 450, 453, 455

[56] References Cited

U.S. PATENT DOCUMENTS

| | | | |
|---|---|---|---|
| D. 310,903 | 9/1990 | Anderson | D34/1 |
| 448,691 | 3/1891 | St. John . | |
| 978,940 | 12/1910 | Saks | 4/450 |
| 1,156,172 | 12/1915 | Poindexter . | |
| 1,376,956 | 5/1921 | Loewenbers | 4/450 |
| 2,087,046 | 7/1937 | Rutan . | |
| 3,597,771 | 7/1969 | Rickmeier . | |
| 4,458,368 | 7/1984 | Webb | 4/300.3 X |
| 4,957,131 | 9/1990 | Robinson | 134/175 |
| 5,048,714 | 9/1991 | Stevens | 220/87 |
| 5,074,322 | 12/1991 | Jaw | 134/56 |

FOREIGN PATENT DOCUMENTS

| | | | |
|---|---|---|---|
| 0429065 | 5/1991 | European Pat. Off. . | |
| 0105021 | 3/1917 | United Kingdom | 4/457 |
| 0765676 | 1/1957 | United Kingdom | 4/300.2 |

*Primary Examiner*—Charles E. Phillips
*Attorney, Agent, or Firm*—McCormick, Paulding & Huber

[57] ABSTRACT

A washing guard for a bed pan provides a means for deflecting splash back and aerosolized particulates from readily passing onto health care workers and/or other patients thereby exposing them to a potential hazard and/or contamination by the particulates and/or splashed effluent coming to rest or splashing onto the worker. The washing guard is further provided with a means for allowing it to be readily attached to a bed pan and includes a means for grasping and holding it in a vertical oriented orientation such that the health care worker is free to use his or her free hand to wash the bed pan with a spray jet while assembled to the washing guard.

13 Claims, 4 Drawing Sheets

BEDPAN WASHING GUARD WITH ANTI-SPLASH BACK FEATURE

BACKGROUND OF THE INVENTION

This invention relates to a guard used when washing bed pans found in hospitals or other health care facilities, and deals more particularly with a bed pan washing guard having means for use after the majority of contained waste is emptied, by attaching the guard to a bed pan so that the guard supports the bed pan during a cleaning procedure and has means for hindering splashing and for passage of aerosolized effluent from the bed pan being washed.

Hitherto the conventional practice in hospitals and other health care facilities that do not utilize automated bedpan washers is to empty bed pans in which effluent, e.g. human waste, is collected and then dumped into a toilet or other drainage facility by a nurse, or other health care worker assigned the task of cleaning the bed pan and completion of the cleaning procedure through usage of a forcible water spray directed into the cavity of the bedpan to rinse remaining effluent. This procedure presents a potential problem to the health care worker inasmuch effluent residuals dislodged with the water spray can splash back onto the worker and/or transformed into an aerosol and contaminate said worker. This known practice of washing a bed pan without a protective guard of the type which the present invention is concerned, contributes to a highly unsanitary practice which could possibly lead to the spread of infections, such as staph, or even to the spread of other bacterial, infectious or even viral diseases. What is particularly problematic with this practice from the standpoint of patient care is that even though the worker covers him or herself with appropriate protective clothing, this clothing can be readily contaminated when particulates of the waste remaining in the bed pan after dumping, when sprayed by the high pressure jet nozzle of a water spray head, are splashed back onto the worker. Moreover, these particulates when subjected to a pressure spray, become aerosolized by the water stream which upon impacting on the surface of the bedpan become suspended in the air with the atomized water. These particulates if not prevented from becoming air-born, may come to rest on the clothes or skin of the health care worker, subjecting the worker to potential contamination, and/or are carried with him or her to the next patient's room where the potential for contamination and/or transmitting of disease to another exists.

Accordingly, it is an object of the present invention to provide a washing guard for bed pans of the aforementioned type having means for containing effluent which may otherwise be splashed onto a worker during washing, and for containing particulates of the waste contained in the pan which may become suspended in the air as a result of being impacted on by a water spray jet directed onto the bed pan inner surface during a cleaning process by the user.

Still a further object of the invention is to provide a low-cost reuseable washing guard of the aforementioned type which is capable of withstanding sterilization processes common to the medical industry and is readily connectable to a bed pan for covering it during a cleaning procedure and thereby hindering aspirated effluent from being released directly onto the involved worker.

Further objects and advantages of the invention will become apparent from the below disclosure and the appended claims.

SUMMARY OF THE INVENTION

This inventions relates to a washing guard for containing effluent in a bed pan and provides a means for deflecting a splash and aerosolized particulates from passing into the air and onto a health care worker charged with the responsibility of cleaning the involved bed pan. For this purpose, the bed pan washing guard is comprised of perimeter means defining the general shape of the washing guard and being disposed about a central axis of the washing guard extending longitudinally thereof and has a generally bowl-shaped shield portion integrally connected with the perimeter means, the shield portion having a inner surface and an outer surface, the inner surface thereof defining an internal chamber therein. Formed in the top central surface of the shield portion is an orifice means centrally disposed on the shield portion coincidentally with the central axis, the orifice means including a central opening communicating between the shield portion inner surface and the shield portion outer surface to effect communication of a cleaning implement between an external environment associated with the outer surface of the shield portion and within the internal chamber associated with the shield portion and inner surface. Means are provided and are disposed at one end of the washing guard interrupting the otherwise created internal chamber of the shield portion to allow passage of effluent from within the internal chamber outwardly thereof The washing guard further includes means associated with the perimeter means for coupling the washing guard to a bed pan and includes means for holding the washing guard and the bed pan with one another when the washing guard and the bed pan are disposed vertically such that the passage means is disposed downwardly of the holding means.

DETAILED DESCRIPTION OF THE PREFERRED EMBODIMENT

Figure 2:
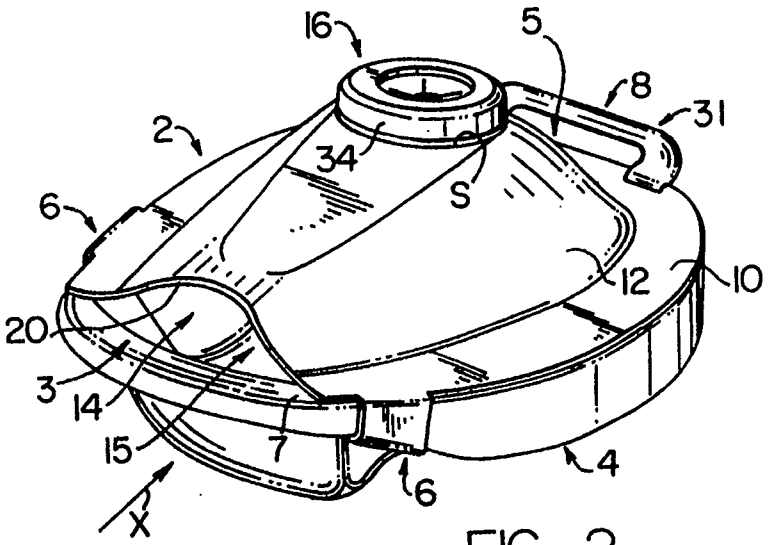
FIG. 2 is a perspective view of the bed pan washing guard and the conventional bed pan of FIG. 1 shown as an assembly.
Figure 1:
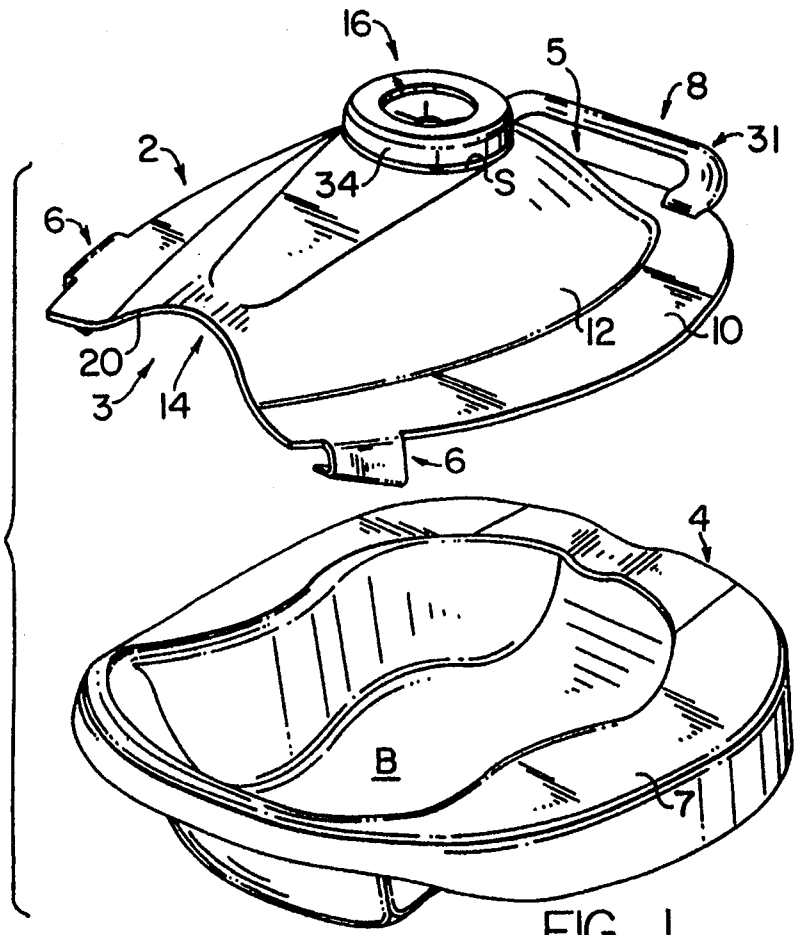
FIG. 1 is an exploded view showing a bed pan washing guard of the invention and a conventional bed pan to which it is capable of being used.

In FIGS. 1 and 2 a bed pan washing guard illustrated generally as 2 is shown. The washing guard is particularly constructed and adapted for use with and to be connected to a conventional bed pan illustrated as 4 in the manner best illustrated in FIG. 2. The washing guard 2 has a means 6 disposed at one end 3 thereof for attaching to and releasably holding the bed pan about its rim 7 and has a discharge means 14 associated with the one end 3 for permitting the passage of effluent therefrom. The washing guard further has a handle means 8 disposed at the opposite end 5 thereof for allowing the user to hold the washing guard 2 with the bed pan gripped to it so that the pan and the washing guard are oriented substantially vertically to allow the contained effluent to flow downwardly into an appropriate drain facility through the discharge means 14. The washing guard 2 further includes a generally bowl-shaped shield portion 12 defining an internal chamber 15 and an orifice means 16 associated with the shield portion for permitting the introduction of a cleaning jet into the internal chamber 15 so that when assembled as shown in FIG. 2, the washing guard and pan create a substantially contained confine into which the water is forcibly introduced.

Figure 3:
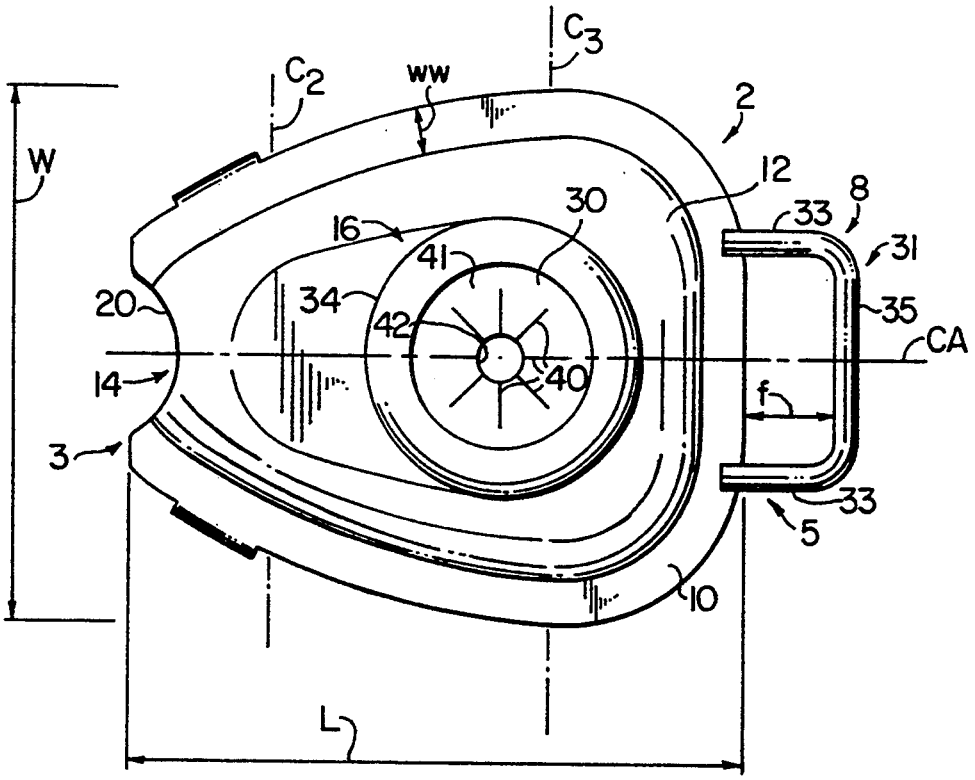
FIG. 3 is a top plan view of the bed pan washing guard of the invention.
Figure 4:
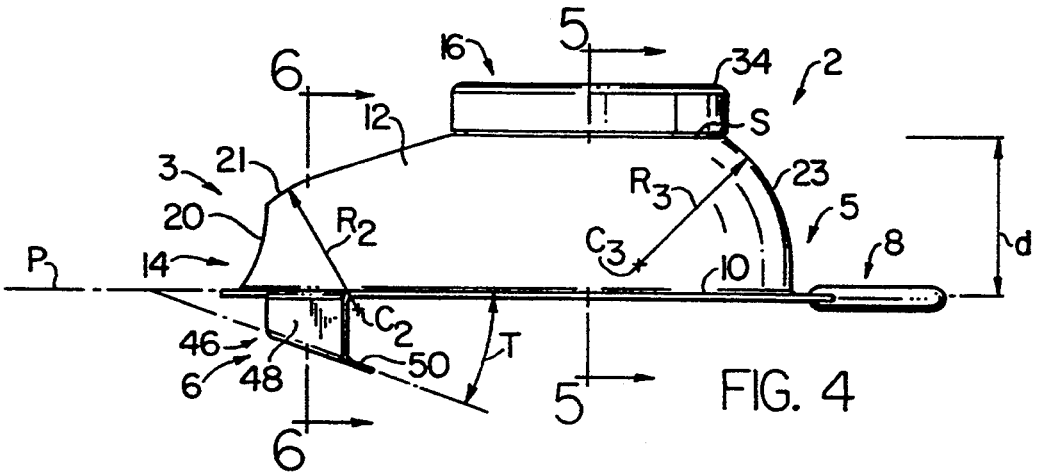
FIG. 4 is a side elevation view of the bed pan washing guard shown in FIG. 3.

As best shown in FIGS. 3 and 4, the washing guard 2 is primarily defined by a generally shield-like shape defined about its periphery by a peripheral flange member 10 which extends entirely about the washing guard and is only interrupted along this perimeter by the discharge means 14 which is provided for the purpose of allowing the effluent to pass from the bed pan when the washing guard is assembled on it in the manner illustrated in FIG. 2. For purposes of illustration, the peripheral flange member 10 gives the washing guard 2 a length L equal to approximately 13½" and a width W equal to approximately 11½" sufficient to cover standard bed pans used in the industry. The peripheral flange member 10 and the shield portion 12 are unitarily molded in a single piece construction of, for example, clear plastic, so as to have contiguous inner and outer surfaces 17 and 19 together defining a given generally uniform thickness th of the washing guard equaling about ⅛". This plastic material should be selected from ones which are capable of withstanding the pressure and temperatures of sterilization processes, such as, for example, from polycellphone, sold commercially by Amoco Corp. under the tradename RADEL. The peripheral flange member 10 has a width ww sufficiently wide to bear on the top confronting surface of the rim 7 of a commercially standard bed pan 4 and is disposed symmetrically about a central or symmetrical axis CA extending longitudinally of the washing guard 2. The width dimension ww extends coincidentally with a common plane P which contains the flange member, and in the preferred embodiment has a value equal to about 1". The integrally formed body or shield portion 12 extends inwardly of the peripheral flange member 10 toward the central axis CA in a curved manner and ending in an outermostly disposed planar surface S located a distance d from the plane P. The dimension d is selected so as to create an optimum chamber of volume having a distance from the bottom surface B of the bed pan sufficient to insure that the washing guard deflects the water stream directed at the surface B back into the internal chamber 15 and not abruptly against the inner surface 17 of the shield portion 12, and in the preferred embodiment, this dimension equals about 3⅜".

The handle means 8 is connected to the peripheral flange member 10 at the end 5 of the washing guard 2 and is defined by a generally U-shaped handle member 31 which connects to the flange 10 through connecting parts 33,33 disposed parallel to the central axis CA, and integrally connected to one another by a transverse part 35 spaced from the juxtaposed edge of the flange member 10 by a distance f, equaling approximately 2 inches, which spacing f being sufficient to permit the grasping of the bed pan rim 7 by the last terminal fingers of a hand while the part 35 of the handle remains grasped between the thumb and index finger.

Figure 6:
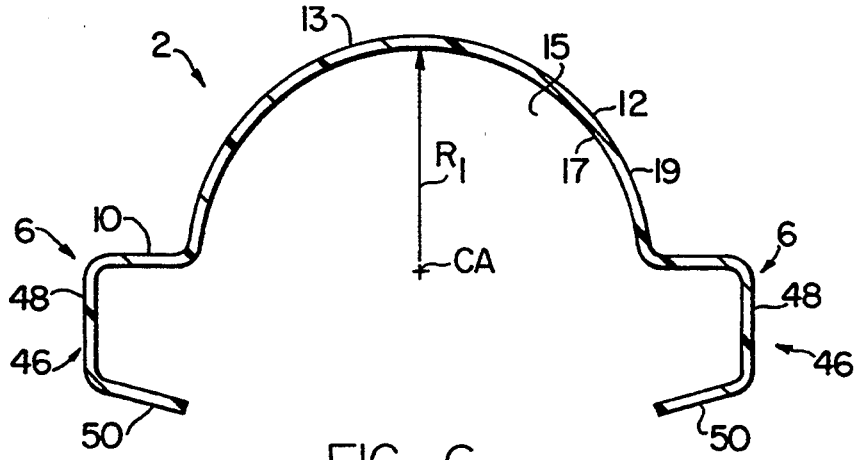
FIG. 6 is a vertical sectional view taken along line 6—6 in FIG. 4.

As previously stated, the shield portion 12 has a generally bowl-like shape as defined by a plurality of radii which combine to create given curvatures in the shield portion 12 directed in different directions with respect to given centers of curvature. As illustrated in FIG. 6, radii $R_1$ have a center of curvature which are coincident with the central axis CA and are variable in length with respect to the longitudinal profile of the shield portion to create the curved surface 13 which curves in a direction orthogonally to the central axis CA. Radii $R_2$ have centers of curvature which are coincident with line $C_2$ shown in FIGS. 3 and 4 and are provided for the purpose of creating a second curvature 21 curving in a direction parallel to the central axis CA. A third curvature 23 is formed in the shield portion 12 adjacent the handle means S and is defined by a plurality of radii $R_3$ each having a common center of curvature disposed coincidentally along a line $C_3$ disposed orthogonally to the central axis CA.

The discharge means 14 of the washing guard 2 as seen in FIG. 3, is best described as being an interruption or a cutout 20 made in the shield portion 12 and in the peripheral flange 10 of the washing guard 2 adjacent the lower end of the washing guard 2 for allowing effluent to pass out of the internal chamber 15 when the washing guard and bed pan are held vertically with the cutout oriented downwardly toward the drain. As can be seen in FIG. 4, the second curvature 21 is thusly disposed proximate the cutout 20 on the shield portion 12 so as to provide a secondary collecting area in the chamber 15 to permit a more even flow of the effluent out of the internal chamber 15 when the washing guard and pan assembly is held vertically with the one end 3 located downwardly of the opposite other end 5.

Figure 5:
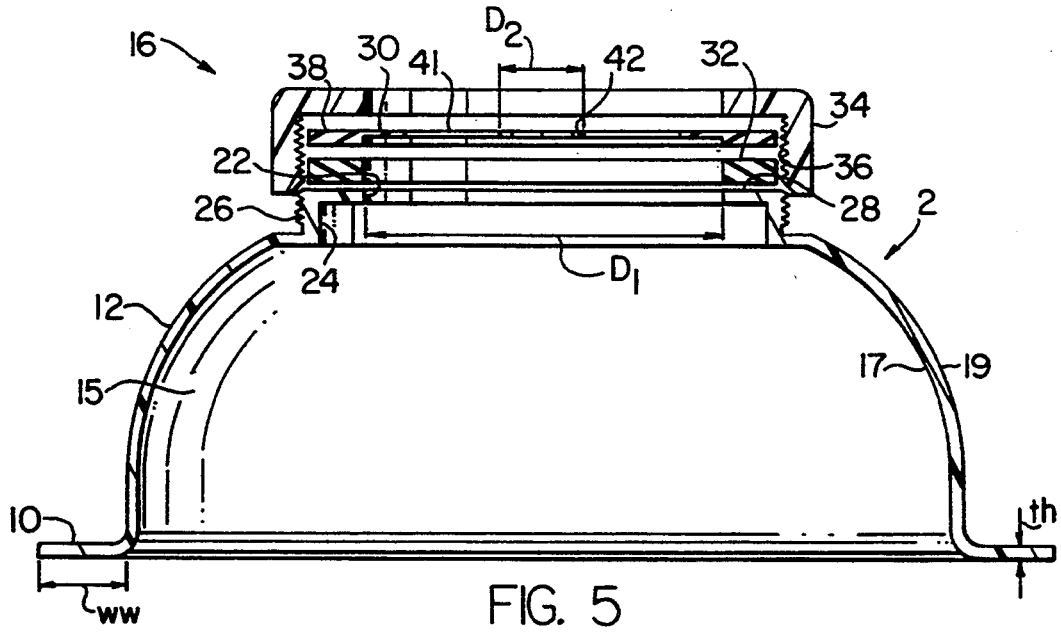
FIG. 5 is a vertical sectional view, shown exploded, taken along line 5—5 in FIG. 4.
Figure 7:
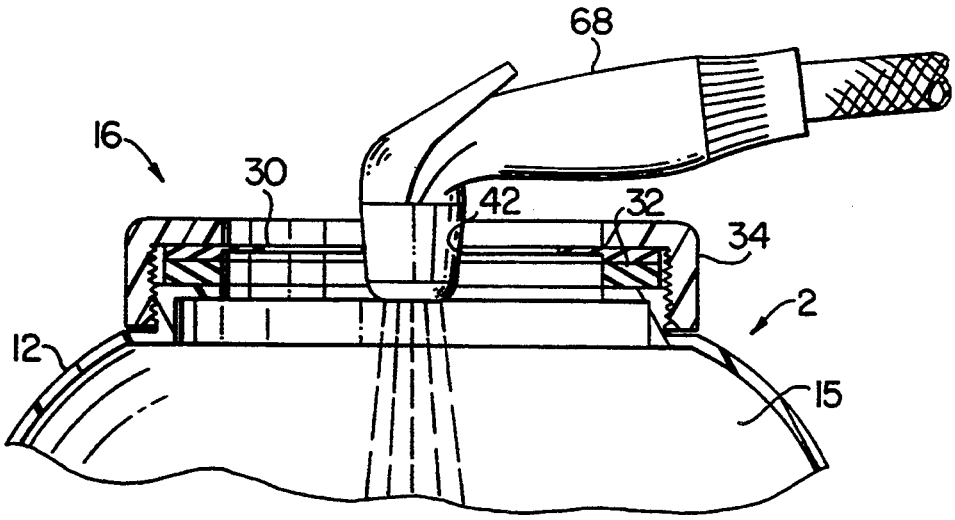
FIG. 7 is a vertical sectional similar to FIG. 5 shown with a spray head inserted therein.
Figure 8:
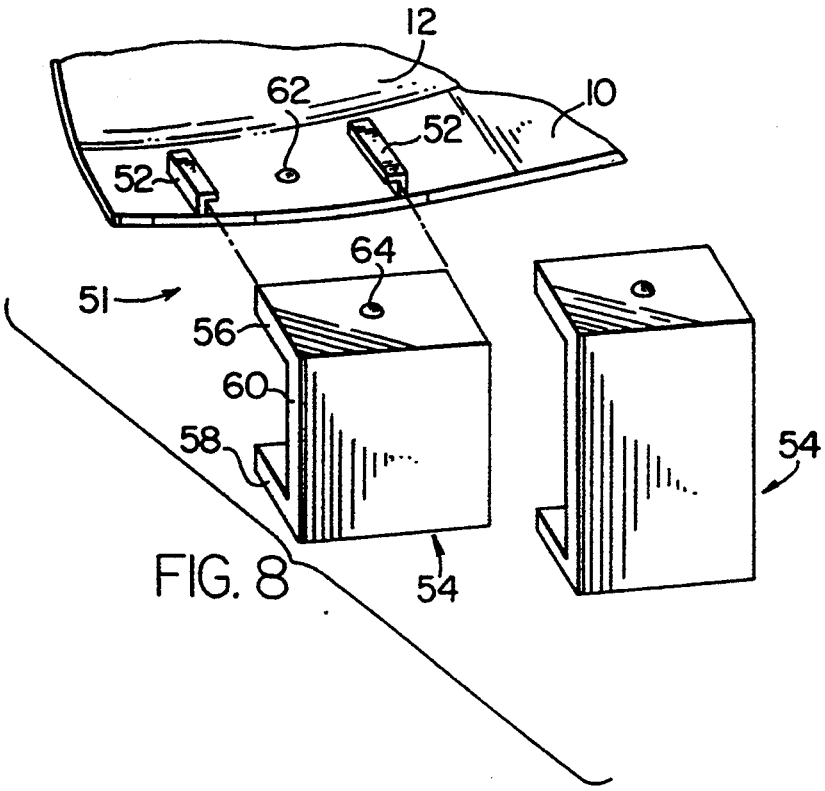
FIG. 8 is a an alternative embodiment of the bed pan washing guard shown in FIG. 1 wherein clip means are used to attach the washing guard to an associated bed pan.

As best illustrated in FIG. 5, the orifice means 16 provides an opening for receiving the spray head of a washing element inserted into the internal chamber 15 of the washing guard 2 in the manner illustrated in FIG. 7, and is further provided with a means for preventing the outward passing of the aerosolized effluent from the otherwise substantially enclosed containment created by the connected washing guard 2 with the pan 4. This means 16 includes an opening 22 formed in the surface S defined by an annularly upstanding flange 24 threaded about its periphery at 26. The depending annular flange 24 further has an integrally formed radially inwardly directed flange portion 28 whose inner edge defines the actual passage diameter $D_1$ of the opening 22. For purposes of protecting against aerosolized and splashed effluent passing out of the internal chamber 15, a means is provided and is comprised of an aerosol deflector membrane 30, a gasket ring 32 and an annular retainer nut 34 having an inwardly disposed threaded face 36 and being appropriately sized and configured to cooperatively engage with the threads 26 on the annular depending flange 24 so as to clamp the aerosol deflector membrane in place and against the inwardly directed flange portion 28 of the surface S. As illustrated in FIG. 3 and 5, the aerosol deflector membrane 30 for this purpose includes an annular rim portion 38, a substantially rigid membrane material 41 integrally connected with the rim portion 38 and having a plurality of slits 40,40 radially outwardly connected to a flexible central opening 42 formed concentrically with the rim portion 38 to allow passage of a spray head into the internal chamber 15 without regard to nozzle sizes which are larger than the diameter $D_2$ of the opening 42. For purposes of illustration, the diameter $D_2$ of the opening 42 is equal to about 1" and the diameter $D_1$ of the opening 22 in the surface S is approximately 4 times as large. The material from which the membrane is formed while being capable of being made from many different materials, is in the preferred embodiment, formed from neoprene.

The washing guard 2 is specifically adapted to be mechanically coupled with a bed pan along its top rim 7 and accomplishes this through the combined intermediary of the handle means 8 acting with the holding means 6 each disposed at opposite ends of the washing guard. For this purpose, the holding means 6 in the preferred embodiment includes two depending flange means 46,46 each integrally formed with the peripheral flange 10 and extending outwardly of the plane P orthogonally to it in a direction opposite that taken by the shield portion 12. Each of the holding flange means 46,46 includes a depending portion 48 and an inwardly turned gripping portion 50 each directed toward the central axis CA and disposed at an angle T relative to the plane P. The angle T, which, in the illustrated embodiment, is equal to about 25°, is selected so as to cause the gripping flange portion 50 of each of the flange means 46,46 to wedge with the underside of the rim 7 of the bed pan 4 when the washing guard 2 is slid over the top of the pan in the indicated direction X to achieve the complimentary engagement therebetween. Alternatively, as illustrated in FIG. $, the washing guard 2 may be formed without the holding flanges means 46,46 integrally formed with the perimeter flange 10, and in this case the holding means 6 takes the form of a separable connecting means 51 associated with the perimeter flange 10 for coupling the washing guard to the bed pan. For this purpose, the means 51,51 includes two pairs of spaced apart receiving channels 52,52 disposed on the perimeter flange 10 adjacent the cutout 20 on either sides of the central axis CA. Clip means 54,54 (shown in two sizes) formed from a substantially rigid yet resilient material, such as, plastic are also provided and have a top flange portion 56 which is appropriately sized and shaped to be received within the channels 52,52 and a bottom flange portion 55 integrally connected to the top flange portion by a connecting web portion 60 and being appropriately sized and shaped to engage the rim 7 of the bed pan in a snap fit connection. To assist in this connection, a bead 62 is formed on the flange 10 and is appropriately sized and shaped to be received within a corresponding opening 64 in the top flange 56 of the clip means 54,54.

In operation, the health worker in disposing of the effluent contained in the bed pan 4 manipulates the washing guard 2 onto it to cause the holding means 6 to engage the frontal pan rim and wedge the washing guard in place. With the holding means 6 of the washing guard acting on the rim of the bed pan in this manner, the handle means 8 of the washing guard is grasped such that it is held between the thumb and the index finger of his or her hand and causes the remaining fingers of the hand to grasp the back of the rim of the bed pan. The pan and the washing guard are then held vertically such that the cutout 20 is directed downwardly below the handle means 8 to an appropriate drain facility where its contents are emptied through the cutout 20. Thereafter, the user with his or her free hand inserts a spray head nozzle 68 into the opening 42 of the aerosol deflector 30 in the manner shown in FIG. 7 and causes flushing of the internal chamber 15 to remove the waste deposits.

By the foregoing, a bed pan washing guard has been disclosed by way of illustration rather than limitation. For example, the guard while disclosed primarily for use as a washing guard, is also capable of being used as a cover in the transport of a bed pan containing waste as it is moved between a patient's room an emptying facility. Thus, numerous substitutions and modifications may be had without departing from the spirit of the invention.

I claim:

1. A bed pan washing guard having an antisplash-back rinsing feature comprising:

a peripheral member defining generally the outline of said washing guard;

a generally bowl-shaped shield portion integral with said peripheral member, said shield portion having an inner surface and an outer surface, said inner surface thereof defining an internal chamber therein;

an orifice formed in said shield portion and communicating with said shield portion inner surface and said shield portion outer surface to effect communication of a cleaning implement between an external environment associated with said outer surface of said shield portion and said internal chamber;

discharge means disposed at one end of said washing guard for interrupting said internal chamber of said shield portion for allowing discharge of effluent from within said internal chamber and outwardly downwardly thereof;

means attached to said guard at said one end for releasably holding said bed pan to said washing guard;

a handle connected to said washing guard disposed on said guard generally adjacent an end opposite said one end, and wherein said peripheral member contacts an upper surface of said bed pan and said means for releasably holding said bed pan to said washing guard engages another surface of said bed pan spaced from said bed pan upper surface so that the guard will function to hold and cradle said bed pan such that a user may grasp and handle so as to orient said bed pan in a vertical position with said discharge means disposed below said handle to allow discharge of the contents of said bed pan including cleaning liquid communicated via said orifice from said discharge means, and said guard will prevent the contents from exiting said internal chamber substantially other than via said discharge means.

2. A washing guard as defined in claim 1 further characterized by said releasable holding means being disposed adjacent said interruption in said shield portion and being formed integrally with said perimeter means.

3. A washing guard as defined in claim 2 further characterized in that said releasable holding means is comprised of a pair of holding flanges disposed on opposite sides of said central axis and having a first flange portion integrally connected with said perimeter means and extending outwardly orthogonally thereto and having a second flange portion inwardly turned relative to said central axis and oriented at an angle relative to said perimeter means.

4. A washing guard as defined in claim 3 further characterized by said peripheral member being a peripheral flange of a given thickness extending about said washing guard in a given plane; and wherein that discharge means includes a cutout interrupting both said peripheral flange and said shield portion.

5. A washing guard as defined in claim 4 further characterized in that said shield portion includes a substantially planar central surface contiguously formed with curved surfaces of said shield portion extending between said planer surface portion and said perimeter flange member.

6. A washing guard as defined in claim 5 further characterized in that said orifice is formed on said substantially planar central surface of said shield portion and includes an aerosol deflector means for permitting the passage of a cleaning instrument through said opening yet preventing the passage of aerosol waste from moving outwardly from said internal chamber.

7. A washing guard as defined in claim 6 further characterized in that said aerosol deflector means includes a substantially circular membrane member having a flexible opening substantially smaller in diameter than said central opening and having a plurality of radially extending slits formed in said membrane member and extending from said flexible opening through substantially the diameter of said central opening; and wherein said membrane is formed from a flexible material.

8. A washing guard as defined in claim 7 further characterized in that said orifice includes an annular recess formed in said central planar surface of said shield of portion and defined by an annularly extending flange portion and an inwardly directed flange portion integrally connected to one another to define said central opening in said shield portion, said annularly depending flange portion having a threaded external surface and said orifice means further including an annular nut member configured to threadily be received about said depending annular flange to capture said deflector membrane between said annular nut member and said inwardly directed flange member.

9. A washing guard as defined in claim 8 further characterized in that said generally bowl-like shield portion of said washing guard having a first curvature curving in a direction orthogonally to said central axis and being defined by radii of curvature which vary along the longitudinal profile of said shield member as taken along said central axis;

and second and third curvatures formed in said generally bowl-like shield portion of said washing guard each curving in a direction parallel to said central axis and each being defined on opposite sides of said central substantially planer surface of said shield portion.

10. A washing guard as defined in claim 9 further characterized in that said handle includes a generally U-shaped handle member connected to the peripheral flange through connecting parts disposed parallel to the central axis and integrally connected to one another by a transverse part spaced from the juxtaposed edge of the peripheral flange by a distance sufficient to permit the grasping of a bed pan rim by the last terminal fingers of a hand while the transverse part of the handle is remains grasped between the thumb and index finger of the worker.

11. A washing guard as defined in claim 2 further characterized by said releasable holding means being a separable connecting means associated with the perimeter means for coupling the washing guard to the bed pan, said separable connecting means including two pairs of spaced apart receiving channels disposed on the perimeter means on either side of the central axis and including clip means formed from a substantially rigid yet resilient material having a top flange portion which is appropriately sized and shaped to be received within the associated channel and a bottom flange portion integrally connected to the top flange portion by a connecting web portion and being appropriately sized and shaped to engage the rim of a bed pan in a snap fit-type connection.

12. A bed pan washing guard comprising:

a perimeter flange member disposed symmetrically about a given central axis and extending in a given plane, said perimeter flange member being interrupted at a point along its perimeter coincidentally with the intersection of said central axis at one end of said washing guard;

said washing guard at an end opposite said one end and at a location coincident with the intersection of said central axis and said perimeter flange including a handling means for allowing said washing guard with a bed pan coupled to it to be manipulated so as to effect emptying of the waste contained therein;

a generally bowl-like shield portion integrally formed with said perimeter flange member and extending outwardly from said given plane a given distance to define an internal confine therein;

a first and a second flange extending outwardly of said given plane in a direction oppositely of the direction in which said shield portion extends, said first and said second flange portions being integrally connected with said perimeter flange member at a location proximate the interruption of said perimeter flange member;

said substantially bowl-like shield portion having a generally planer central surface disposed coincidentally with said central axis and including a through opening formed therein for permitting the passage of a cleaning tool from an external environment to an internal chamber defined by the shield portion;

said opening further including means for preventing the passage of waste from moving between said internal chamber to an external environment;

wherein said handling means and said holding means together allowing said washing guard and said bed pan to be held vertically upright so as to orient the interruption in said shield portion at a position lower than said handling means to allow waste contained in a bed pan to be removed.

13. A method of cleaning a bed pan using a washing guard having an antisplash-back rinsing feature comprising the steps of:

providing a washing guard having a peripheral member defining generally the outline of said washing guard and having a generally bowl-shaped shield portion integral with said peripheral member, said shield portion having an inner surface and an outer surface, said inner surface thereof defining an internal chamber therein;

providing an orifice formed in said shield portion communicating with said shield portion inner surface and said shield portion outer surface to effect communication of a cleaning implement between an external environment associated with said outer surface of said shield portion and within said internal chamber associated with said shield portion inner surface;

providing discharge means disposed at one end of said washing guard for interrupting said internal chamber of said shield portion for allowing discharge of effluent from within said internal chamber and outwardly downwardly thereof;

providing means attached to said guard at said one end for releasably holding said bed pan to said washing guard;

and a handle connected to said washing guard disposed on said guard generally adjacent an end opposite said one end; and assembling said washing guard to a bed pan to be cleaned using said means for releasably holding said bed pan to said washing guard such that said peripheral member contacts an upper surface of said bed pan and said means for releasably holding said bed pan to said washing guard engages another surface of said bed pan spaced from said bed pan upper surface so that the guard will function to hold and cradle said bed pan such that the user may grasp said handle so as to orient said bed pan in a vertical position with said discharge means disposed below said handle to allow discharge of the contents of said bed pan including cleaning liquid from said discharge means so that the guard will prevent the contents and cleaning liquid from exiting said internal chamber substantially other than via said discharge means; and inserting a spray jet into said orifice formed in said shield portion to introduce a cleaning fluid stream into said internal confines such that the washing liquid rinses clean the bed pan and discharges downwardly through the discharge means.

* * * * *